US005313144A

United States Patent [19]

Butler et al.

[11] Patent Number: 5,313,144

[45] Date of Patent: May 17, 1994

[54] POWER BALANCED COUPLING STRUCTURE FOR ELECTRODELESS DISCHARGE LAMP

[75] Inventors: Scott J. Butler, North Oxford; Walter P. Lapatovich, Marlborough, both of Mass.; Jason R. Bochinski, Springfield, Oreg.

[73] Assignee: Osram Sylvania Inc., Danvers, Mass.

[21] Appl. No.: 999,636

[22] Filed: Dec. 31, 1992

[51] Int. Cl.[5] ..... H05B 41/16

[52] U.S. Cl. ..... 315/248; 315/39; 315/344

[58] Field of Search ..... 315/248, 344, 267, 39; 343/821, 859; 333/26, 120, 128

[56] References Cited

U.S. PATENT DOCUMENTS 5,113,121 5/1992 LaPatovich et al. ..... 315/248

5,241,246 8/1993 LaPatovich et al. ..... 315/248

*Primary Examiner*—Robert J. Pascal

*Assistant Examiner*—Haissa Philogene

*Attorney, Agent, or Firm*—William E. Meyer

[57] ABSTRACT

An electrodeless HID lamp formed with a power balanced coupling structure is disclosed. Microwave transmission to the discharge capsule is divided into two channels having an electrical length differential of about a half wave length. A balancing strap line is coupled between the two transmission lines where they deliver power to the field applicators for the discharge capsule. The strap line balances the power delivery between the two ends of the discharge tube.

18 Claims, 2 Drawing Sheets

POWER BALANCED COUPLING STRUCTURE FOR ELECTRODELESS DISCHARGE LAMP1.

TECHNICAL FIELD

The invention relates to electric lamps and particularly to discharge lamps. More particularly the invention is concerned with electrodeless discharge lamps.

2. BACKGROUND ART

Microwave power may be used to power a high intensity discharge. The lamp typically comprises a quartz capsule containing an excitable set of gases and chemical dopants. Microwave radiation is then directed at the capsule, causing the fill materials to heat to a plasma state and emit light. The discharge may have high intensity, and because there are no electrodes penetrating the capsule wall, the lamps are referred to as electrodeless high intensity discharge lamps, or electrodeless HID lamps.

Microwave electrodeless HID lamps in the past have been coupled to power sources using termination fixtures which were typically large, bulky shielded coaxial structures. The shielding has been an incumberance to the efficient capture and display of the emitted light.

A novel dual ended excitation scheme was disclosed by Lapatovich in U.S. Pat. No. 5,070,277. Microstrip line conductors were coupled to microwave applicators directed at a tubular capsule. Microwave applicators that have been used with tubular capsules include slow wave helices, end cups, loop applicators and so forth. The dual ended excitation scheme provides substantial flexibility with respect to impedance matching techniques compared with the older termination fixture techniques. Considerable reduction in size and weight of the microwave coupler was achieved. With the reduced size of the applicator, more of the emitted light could be used in an optical system. The coil coupling and strip line patterning structures required an external variable impedance matching means, which can be bulky and expensive. There is then a need for a microwave circuit pattern for electrodeless lamps having balanced power distribution.

Nevertheless, when certain combinations of discharge capsules and power couplers, are implemented with a half wave balun, or a T junction and half wave balun, there is a greater power loss in the longer arm of the half wave balun structure. The power difference is then manifest as a power imbalance in the discharge tube with one end of the tube receiving more power than the other. The power imbalance leads to preferential heating of one end of the discharge capsule and applicator. The additional heat affects lamp performance, lamp longevity, and reliability of the applicator, and transmission line structures. There is then a need for means of overcoming the power imbalance.

DISCLOSURE OF THE INVENTION

An electrodeless lamp having a power balanced coupling structure may be formed to receive microwave power having an operating frequency, through an input line. The received power is divided at a T junction between a first transmission line, having a first electrical length and coupling at a first junction, and a second transmission line, having a second electrical length and coupling at a second junction, wherein the differential electrical length between the first transmission line and the electrical length of the second transmission line is an odd number of half wave lengths of the operating frequency, $n(\lambda g)/2$), for n an odd interger. A strap line couples between the first junction and the second junction and has a third electrical length being an odd multiple of half wavelengths of the operating frequency, $m(\lambda g)/2$), for m odd interger. A first field applicator couples at the first junction to received microwave power from the first transmission line, a second applicator couples at the second junction to received microwave power from the second transmission line, and a discharge capsule receives microwave power from the first field applicator, and the second field applicator to excite the chemical species contained therein and thereby emit useful electromagnetic radiation in the wavelength region between a hundred nanometers and a thousand nanometers, generally known to be ultraviolet, visible and infrared light.

BEST MODE FOR CARRYING OUT THE INVENTION

Figure 1:
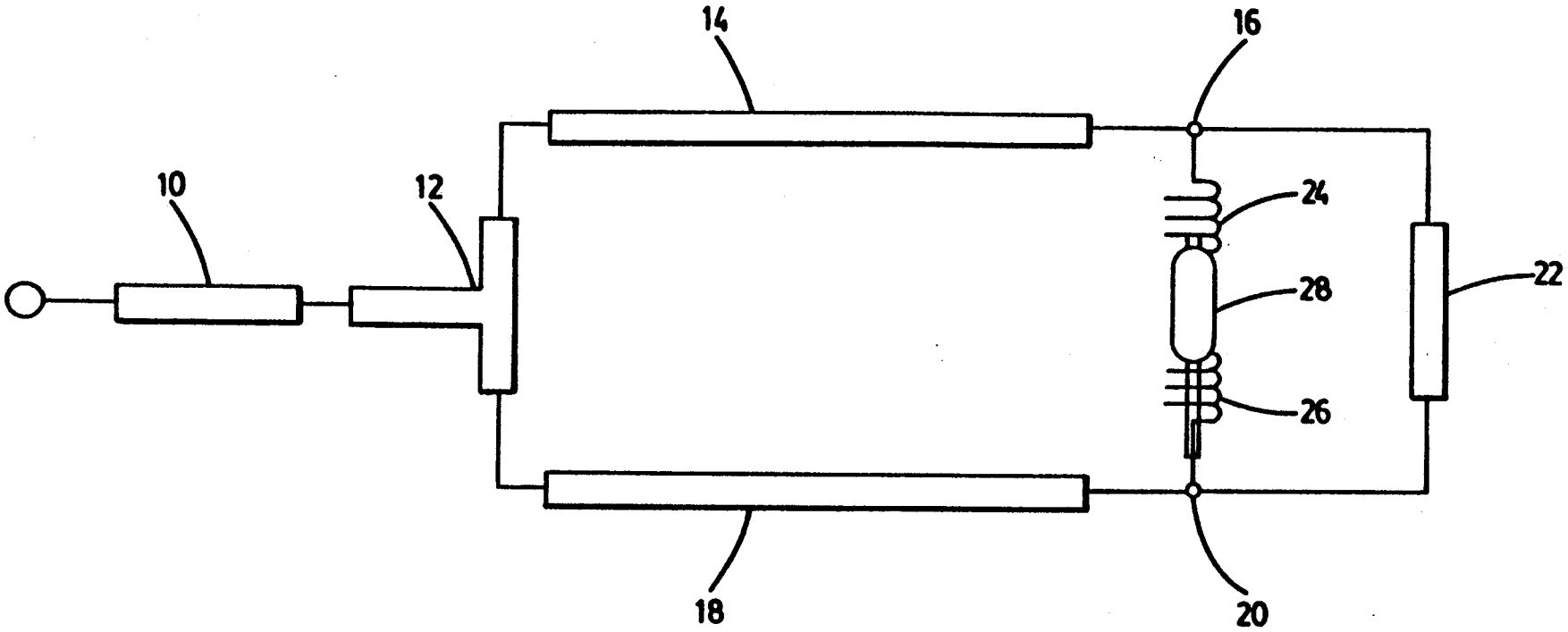
FIG. 1 shows a schematic diagram of a preferred embodiment of a power balanced coupling structure for an electrodeless discharge lamp.
Figure 2:
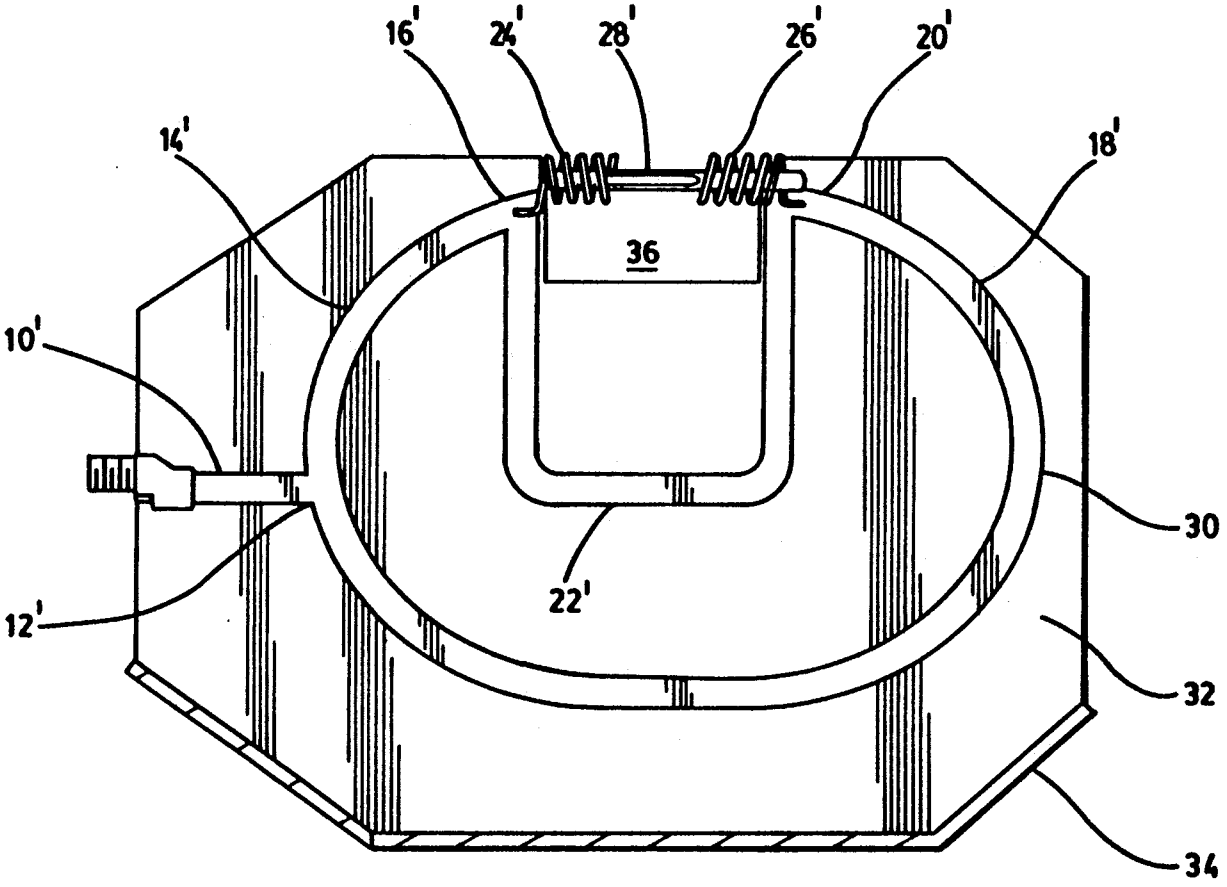
FIG. 2 shows a perspective view a preferred embodiment of a power balanced coupling structure for an electrodeless discharge lamp.

FIG. 1 shows a schematic diagram of a preferred embodiment of a power balanced coupling structure for an electrodeless discharge lamp. The power balanced coupling circuit for electrodeless discharge lamp may be assembled from microwave power delivery channels, such as microstrip line patternings. Microstrip line as used here means a preferred construction wherein a circuit pattern is formed on one side of a insulating board, and a conductive base or ground plane is formed on the opposite side. Strip line, slab line, planar waveguide and microstrip line all generally describe similarly known structures. The circuit includes an input line 10, a first transmission line 14, a second transmission line 18, and a strap line 22. In the preferred embodiment, microstrip line components are executed on a circuit board having the strip line pattern on a first side, an insulative intermediate layer, and a conductive base plane on a second side. FIG. 2 shows a perspective view a preferred embodiment of a power balanced coupling structure for an electrodeless discharge lamp. The embodiment is implemented on a laminated card having a strip line patterning 30 on one side, an intermediate insulating layer 32, and a conductive base plane 34 on an opposite side. The card includes a notched region 36 where a tubular discharge capsule is positioned between two helical microwave applicators. The circuit features of FIG. 1 are noted in FIG. 2 with the primed numberings.

The input line 10 receives power from a microwave input source. The received power typically has a frequency permitted under the ISM bands, such as 915 MHz, or 2.45 GHZ. Other appropriate ISM bands may be used as are permitted. Technically, still further frequencies could be used. The input line 10 maybe a coaxial cable, or a microstrip line connection formed on a laminated card. The preferred embodiment is a coaxial cable connector having one lead coupled to a microstrip line pattern ending at a T connection 12. The second coaxial cable lead is coupled to the base or ground plane.

The input line 10 ends at a power divider, such as a T connection 12. The power divider proportions the supplied power between the first transmission line 14 and the second transmission line 18. When a T connection 12 is used, about half the original power is delivered to the first transmission line 14, and half the power is delivered to the second transmission line 18.

The first transmission line 14 is preferably a microstrip line pattern formed on a laminated card. One side of the card has the microstrip line patterning formed on an intermediate insulative layer, and on the opposite side of the intermediate insulative layer is a conductive base or ground plane. The first transmission line 14 extends from the T connection 12 to a first junction 16 with first microwave applicator 24, such as a wire coil. The first transmission line 14 then supplies power to the first applicator 24 coil.

The second transmission line 18 may be similarly formed strip line pattern on a laminated card. The second transmission line 18 extends from the T connection 12 to a second junction 20 with a second microwave applicator 26, such as a wire coil. The second transmission line 18's length is preferably the same length as first transmission line 14 plus an odd number of half wavelengths of the microwave power delivered $n(\lambda g)/2$ where n is an odd integer and wavelength is the wavelength of the microwave signal in the transmission media. The second transmission line 18 then supplies delayed poker to the second applicator 26 coil.

The differential electrical length of the first transmission line 14 and the second transmission line 18 is important. The differential length should be an odd number of half wavelengths at the operating frequency. The preferred differential electrical length is just one half wave length, however, in applications where a larger differential electrical length is needed or desired, a longer length may be used. The characteristic impedance of the microwave power transmissions lines, the electrical length of the first transmission line 14, and the electrical length of the second transmission line 18 may be tailored to provide impedance matching between the discharge capsule 28 and the microwave power source. While a quarter wave transformer line is disclosed, other combinations of cascaded transmission line sections with prescribed characteristic impedance may be used to provide impedance matching.

The strap line 22 may be a similarly formed microstrip line pattern on a laminated card. The strap line 22 tends from the first junction 16 between the first transmission line 14 and the first applicator 24 coil to the second junction 20 between the second transmission line 18 and the second applicator 26 coil. The strap line 22's electrical length is preferably an odd number of half wavelengths of the microwave power delivered. The strap line 22 acts to suppress the unbalanced power delivery to the first applicator 24, the second applicator 26 and the discharge capsule 28. The strap line 22 then helps balance the power between the first applicator 24 coil and the second applicator 26 coil, by reinforcing odd mode currents and canceling even mode currents. The strap line 22 then reinforces the balanced current components and cancels the unbalanced current components flowing to the applicators 24, 26 and discharge capsule 28.

The first applicator 24 coil and the second applicator 26 coil may be wire helixes positioned coaxially with discharge capsule 28. The discharge capsule 28 may be a tubular capsule enclosing a microwave power excitable mixture of gases and chemical dopants as known in the art. The discharge capsule 28 may be suspended at one or both of its axial ends by mechanical supports as is known in the art.

In one embodiment, the microstrip transmission lines at the output of the T connection 12 had a characteristic impedance of 70.7 ohms. The electrical length of the first transmission line was one quarter wave length, while the electrical length of the second transmission line was three quarters wave length, giving a differential length of one half wave length. The half wave length strap line also had a characteristic impedance of 70.7 ohms. The arrangement provided good impedance matching to two helical couplers, and the discharge capsule, which had a steady state impedance of approximately 100 ohms (real) at 915 MHz. With the appropriate discharge capsule mounted between the applicators, typical 915 MHz return loss performance is approximately to 20 dB at 50 watts input power, and a luminous output of about 6000 lumens. This yields about 120 lumens per watt. Tests indicate that a temperature difference of as much as 218 degrees Celsius can exist between the ends of the discharge capsule in an unbalanced power lamp. With the power balancing strap line in place, a worst case test indicated that temperature difference between the discharge capsule ends was only 12 degrees Celsius. Normal operation, resulted in no detected temperature difference between the discharge capsule ends. The disclosed dimensions, configurations and embodiments are as examples only, and other suitable configurations and relations may be used to implement the invention. While the present work was done at 915 MHz, those skilled in the art will be able to translate the results to other frequencies, such as 2.45 GHz, or other permitted frequencies. Further, while the work was done using microstrip transmission lines, those skilled in the art will be able to translate the results for other transmission channel structures, including strip lines, coaxial cables, waveguides, twinlines and so on.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An electrodeless lamp having a power balanced coupling structure comprising:

a) a microwave power input line for receiving input microwave power with an operating frequency, b) a first transmission line receiving power from the input power line, having a first electrical length and coupling at a first connection, c) a second transmission line receiving power from the input power line, having a second electrical length and coupling at a second junction, wherein the differential electrical length between the first transmission line and the electrical length of the second transmission line is a first odd number of half wave lengths of the operating frequency, d) a strap line coupling between the first connection and the second junction and having a third electrical length being a second odd multiple of half wavelengths of the operating frequency, e) a first applicator coupled at the first connection to received microwave power from the first transmission line, f) a second applicator coupled at the second junction to received microwave power from the second transmission line, and g) a discharge capsule receiving microwave power from the first applicator, and the second applicator to excite the chemical species contained therein and thereby emit useful electromagnetic radiation in the wavelength region between a hundred nanometers and a thousand nanaometers, generally known to be ultraviolet, visible and infrared light.

2. The lamp in claim 1, wherein the input line couples the first transmission line, and the second transmission line at a T coupling.

3. The lamp in claim 1, wherein the first transmission line has an electrical length of one quarter of the wave length for the frequency of operation.

4. The lamp in claim 1, wherein the first transmission line is a microstrip line formed on a first side of the planar insulative material having a second side with an electrically conductive base plane.

5. The lamp in claim 1, wherein the second transmission line has an electrical length equal to the electrical length of the first transmission line, plus one half of the wave length for the frequency of operation.

6. The lamp in claim 1, wherein the strap line has an electrical length equal to one half of the wave length for the frequency of operation.

7. The lamp in claim 1, wherein the first transmission line and the second transmission line are impedance matched to 50 ohms.

8. The lamp in claim 1, wherein the respective electrical lengths of the first transmission line, the second transmission line, and the strap line are chosen with respect to an ISM frequency.

9. The lamp in claim 1, wherein the first transmission line, the second transmission line, and the strap line are formed with coaxial cables.

10. The lamp in claim 1, wherein the first transmission line, the second transmission line, and the strap line are formed with strip lines.

11. The lamp in claim 1, wherein the first transmission line, the second transmission line, and the strap line are formed with waveguides.

12. The lamp in claim 1, wherein the first transmission line, the second transmission line, and the strap line are formed with twinlines.

13. The lamp in claim 1, wherein the first transmission line, the second transmission line, and the strap line are formed with dielectric guides.

14. The lamp in claim 1, wherein the second transmission line has an electrical length equal to $n(\lambda g)/2$ where n is a first odd number and $\lambda g$ is the wave length for the frequency of operation in the strip line media.

15. The lamp in claim 1, wherein the strip line has an electrical length equal to $m(\lambda g)/2$ where m is a second odd number and $\lambda g$ is the wave length for the frequency of operation in the strip line media.

16. The lamp in claim 1, wherein the second transmission line has an electrical length equal to $n(\lambda g)/2$ where n is first odd number, and wherein the strap line has an electrical length equal $m\ (\lambda g)/2$ where m is second odd number not equal to n, and $\lambda g$ is the wave length for the frequency of operation in the strip line media.

17. The lamp in claim 1, wherein the first transmission line, the second transmission line, and the strap line are formed with coaxial cables and the strap line is formed from a planar transmission media.

18. The lamp in claim 1, wherein the first transmission line, the second transmission line, and the strap line are formed with microstrip lines.

* * * * *